US006325076B1

(12) United States Patent
Ramirez

(10) Patent No.: US 6,325,076 B1
(45) Date of Patent: Dec. 4, 2001

(54) COMPACT DENTAL HYGIENE KIT

(76) Inventor: Jorge Ramirez, 2 Hanover Ave., Whippany, NJ (US) 07981

( * ) Notice: Subject to any disclaimer, the term of this patent is extended or adjusted under 35 U.S.C. 154(b) by 0 days.

(21) Appl. No.: 09/344,891

(22) Filed: Jun. 25, 1999

Related U.S. Application Data

(63) Continuation-in-part of application No. 09/139,606, filed on Aug. 25, 1998, now abandoned.

(51) Int. Cl.[7] ..... A45D 44/18
(52) U.S. Cl. ..... 132/309; 132/310; 132/308
(58) Field of Search ..... 132/309, 308, 132/310, 311, 313, 312; 15/167.1

(56) References Cited

U.S. PATENT DOCUMENTS 3,937,235 * 2/1976 Broughton ..... 132/308
4,294,269 * 10/1981 Kyte ..... 132/309
4,673,106 * 6/1987 Fishman ..... 222/80
4,717,278 * 1/1988 Kemeny ..... 401/286
4,887,621 * 12/1989 Vallieres ..... 132/309
4,957,125 * 9/1990 Yaneza ..... 132/309
4,987,910 * 1/1991 Lowe ..... 132/309
5,044,386 * 9/1991 Nelson ..... 132/309
5,348,028 * 9/1994 Gustavel ..... 132/309
5,375,711 * 12/1994 Bree et al. ..... 206/362.2
5,388,599 * 2/1995 Yen ..... 132/308

* cited by examiner

*Primary Examiner*—John J. Wilson
*Assistant Examiner*—Robyn Kieu Doan

(57) ABSTRACT

A compact dental hygiene kit comprising a toothbrush with a foreshortened handle comprising a cap-like fastening means for attachment to the fastening means about the dispensing opening of a tooth paste reservoir, such that the reservoir becomes part of the handle for the toothbrush.

25 Claims, 14 Drawing Sheets

COMPACT DENTAL HYGIENE KIT

This application is a Continuation-in-Part of pending Application Ser. No. 09/139,606, filed Aug. 25, 1998, now abandoned.

FIELD OF THE INVENTION

The present invention relates to compact dental hygiene kits which require little packing space, or which can be easily carried in a pocket, pocketbook or brief case. In particular, the invention comprises a toothbrush, a supply of tooth paste, and optionally, floss, contained in a kit the size of a large pen.

BACKGROUND OF THE INVENTION

Over the years there have been many attempts to provide compact tooth brushing kits. The desire for such a kit has grown as people travel more and eat more meals away from home. In addition, the increasingly popular, expensive, and long term cosmetic and orthodontal dentistry for children and adults need to be maintained. This investment and commitment comes with the ADA recommended care of your teeth: brushing after all meals for a minimum of 3 minutes per brushing. For all these smiling faces we are providing a compact sanitary, refillable, colorful, and easy to use all in one dental hygiene kit.

Prior patented devises have failed to meet this need. Cesari, in U.S. Pat. Nos. 3,741,667 and 4,759,381 describes a toothbrush, which combines a handle with a dispenser for tooth paste.

These devises have numerous disadvantages, including difficulties in refilling the tooth paste supply, drying of the paste and difficulty maintaining the brush and tooth paste in a sanitary state. Quite a number of prior art devices deliver tooth paste up through the neck of the brush, directly to the bristles. In such devices it is difficult to seal the paste from the brush, and hence, to maintain the cleanliness of the brush, or paste reservoir. In U.S. Pat. No. 4,527,574 a container of tooth paste is kept in the hollow handle, and must be completely removed therefrom in order to dispense tooth paste, and then returned to the hollow handle. In U.S. Pat. No. 4,482,263, a supply of tooth powder is kept within the handle of the brush. The handle folds transversely to bring the tooth powder in contact with the bristles. In U.S. Pat. No. 4,693,622 a container of tooth paste is combined with a folded brush head and recessed handle, such that the paste is dispensed onto the bristles, and then, the brushing head unfolded and neck extended; making it difficult to maintain, or even to use, the device while in a sanitary condition.

In contrast, the kit of the present invention permits and mediates the use of sanitary practices similar to those already used for a toothbrush and separate container of tooth paste. In addition, the kit is easily refillable, the toothpaste supply does not get dried out, and the brush is maintained in a sanitary condition away from the paste supply. In certain embodiments of the present invention, a commercially available tooth paste tube may be used in the device.

SUMMARY OF THE INVENTION

The present invention comprises a compact dental hygiene kit. The kit combines a toothbrush and a tooth paste reservoir which serves as a handle for the brush. In its simplest embodiment, the kit comprises a toothbrush with a cap-like fastening means attached to the neck of the toothbrush, and capable of making a firm fastening with the external threads about the dispensing opening of a commercially available tooth paste tube. In still another embodiment, a firming enclosure is provided for a commercially available tooth paste tube, giving it the additional firmness to operate as a handle. The firming enclosure may provide a reusable frame if the kit will be subjected to rough handling as in a book bag.

In another embodiment, the tooth paste is contained within a flexible, refillable sack nestled within a rigid body, which forms the handle of the toothbrush. In this embodiment, the cap-like fastening means may be formed of a coupling which attaches to the foreshortened handle of the brush, and which is capable of making a firm but releasable attachment to the threads of other attachment means disposed about the tooth paste dispensing opening. Various means may be provided to apply pressure to the tooth paste reservoir, to dispense paste from the sack. In addition, the neck of the toothbrush may be provided with a temporary mounting means for attaching the toothbrush to the underside of the body such that the bristles are below the tooth paste dispensing opening, for one handed dispensing. A supply of dental floss may also be included in the kit, e.g. attached to the proximal end of the body or frame.

DETAILED DESCRIPTION OF THE DRAWINGS

Figure 1:
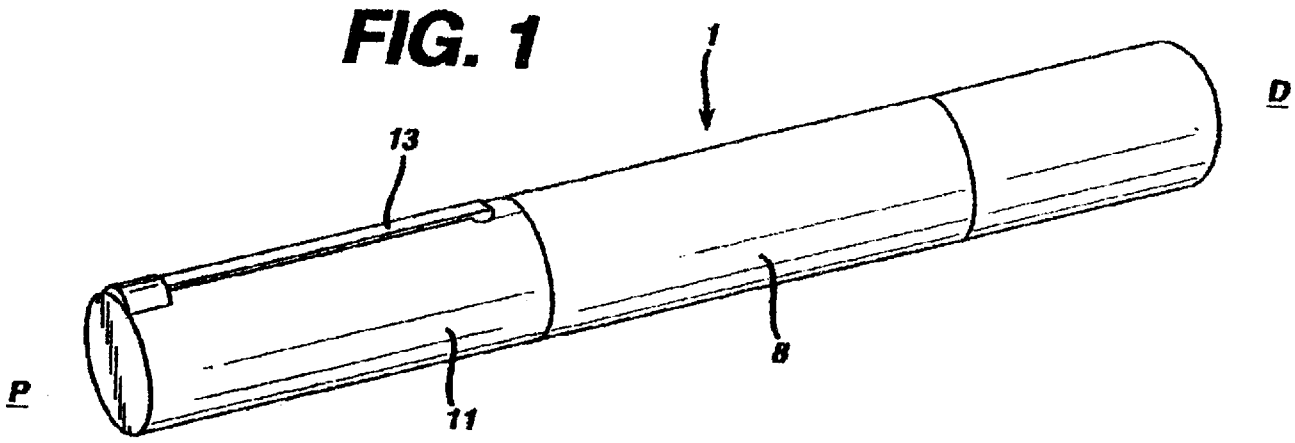
FIG. 1 is a perspective view of the compact dental hygiene kit of the invention, in the fully assembled position.
Figure 1A:
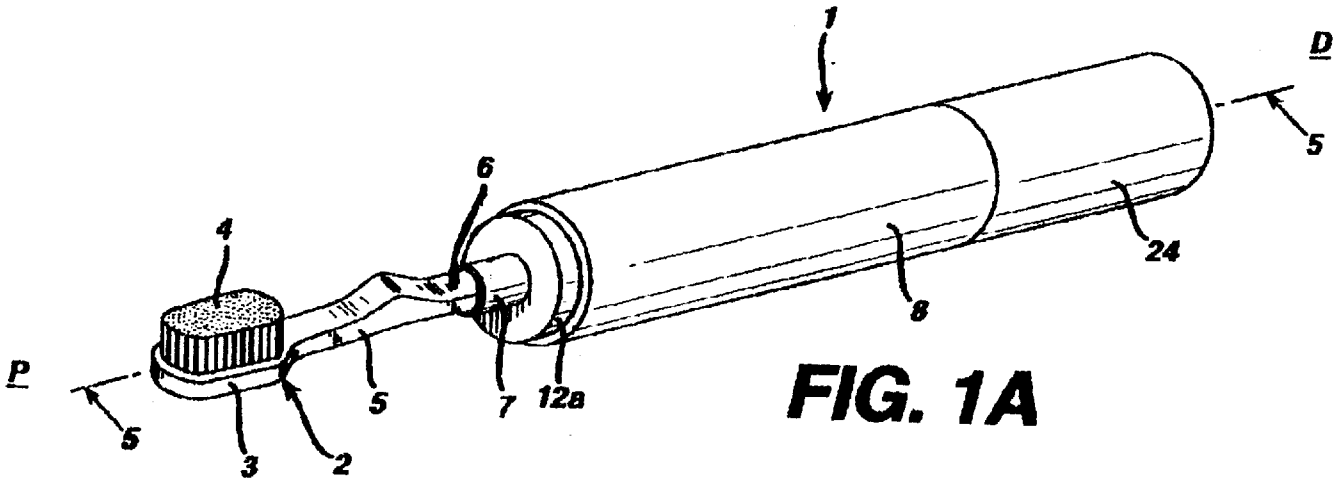
FIG. 1A is a perspective view of the kit of FIG. 1, with the cap removed.
Figure 3:
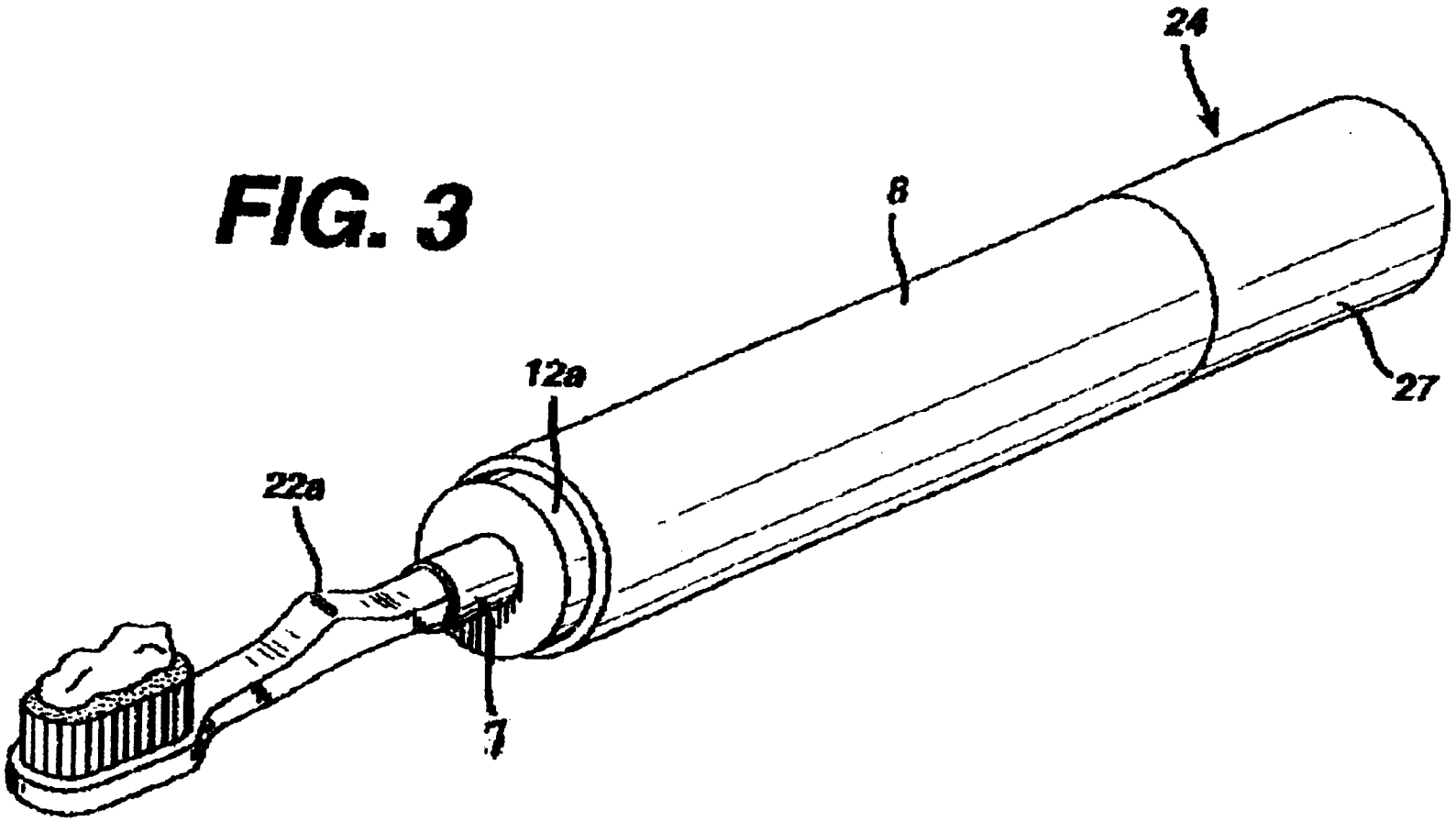
FIG. 3 is a perspective view of the embodiment of FIG. 1, reassembled and ready for brushing.
Figures 4, 6:
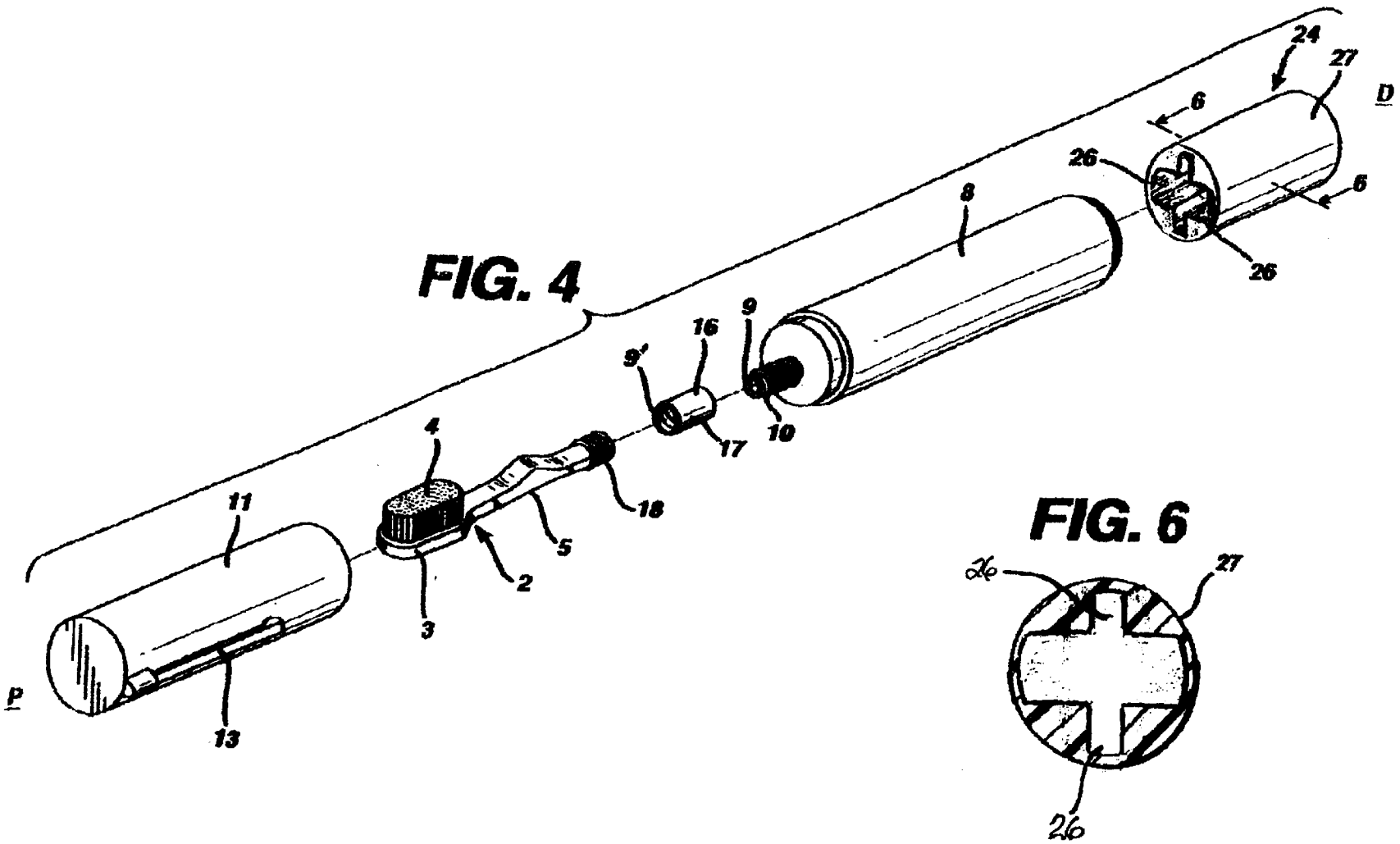
FIG. 4 is a exploded perspective view of a the embodiment of FIG. 1.
FIG. 6 is a cross-section of FIG. 4 along lines 6—6.
Figure 5:
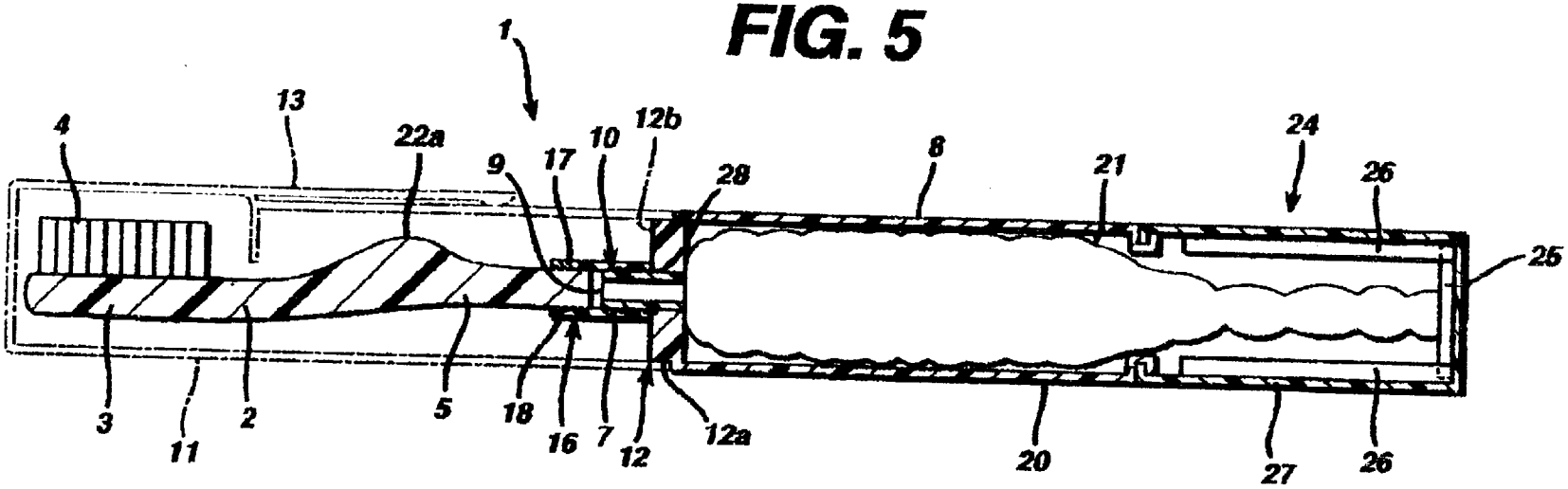
FIG. 5 is a cross-sectional view of the embodiment of FIG. 1 with the cap shown in phantom.

FIGS. 1–6 illustrate the preferred embodiment of the dental hygiene kit of the present invention As shown in FIGS. 1 and 1A the compact dental hygiene kit, shown generally at 1, has a streamlined appearance, similar to a pen. For ease of description of the many parts of the kit, and their mode of attachment, the distal and proximal ends of the kit, and the method of their attachment, are indicated in FIGS. 1, 1A, and 5 by D and P respectively. The kit has a toothbrush, shown generally at 2, having a brushing head, 3, with a plurality of bristles 4. At the distal end of the toothbrush, the brushing head is attached to a neck portion, which may be narrower than the brushing head. Attached to the distal end of the neck portion is a foreshortened handle, which comprises at least a cap-like fastening means, 7. A tooth paste reservoir, 8, has a tooth paste dispensing opening, 9, and fastening means, 10, about the opening, similar to the fastening means of a commercial tooth paste tube. It is, however, contemplated that the fastening means about the dispensing opening could comprise any firm, but releasable fastening, so that when the brush is attached to the reservoir, the reservoir serves as a handle for the toothbrush. Optionally, a cap, 11, may be included with the kit.

Figure 2:
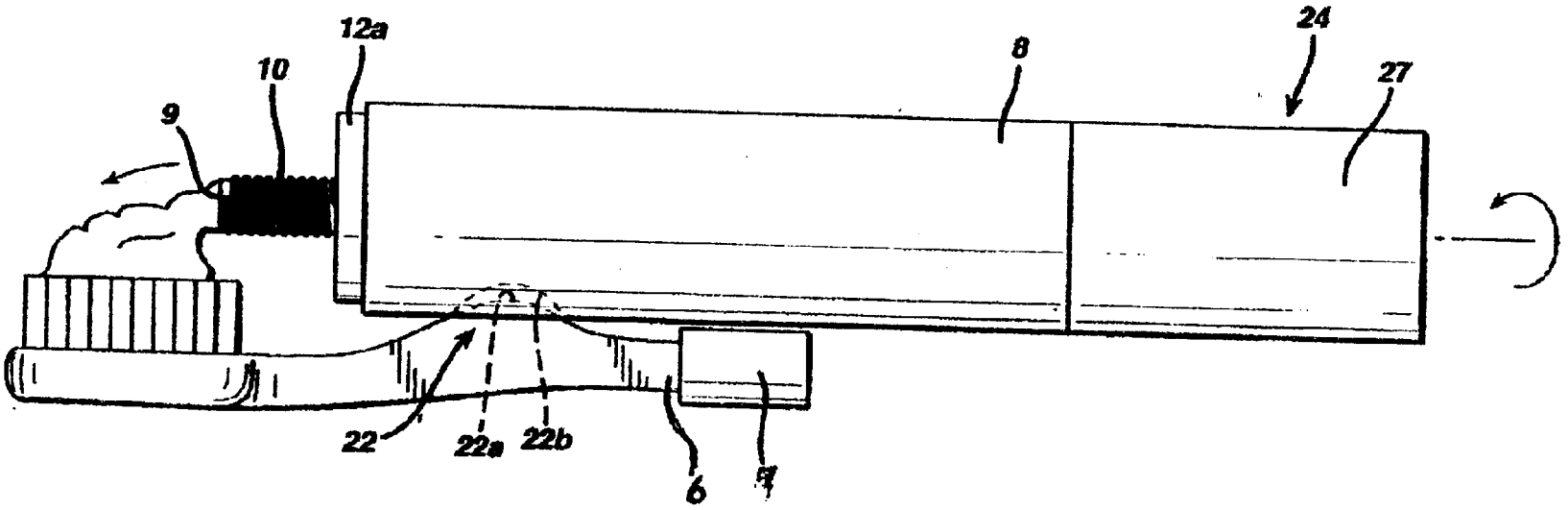
FIG. 2 is side view of the embodiment of FIG. 1, illustrating temporary mounting means for disposing the bristles of the brush at the tooth paste dispensing opening.

As shown in FIG. 2, removal of the cap-like fastening means, 7, from the reservoir, 8, reveals a reservoir fastening means, 10, complementary to the cap-like fastening means. The reservoir fastening means, 10, is disposed about an opening, 9, beneath the cap, for dispensing toothpaste. Reservoir fastening means, 10, makes a firm but releasable, fastening to the cap-like fastening means, 7, to not only cap the tooth paste reservoir, 8, but to attach the toothbrush to the reservoir, so that it may serve as a handle to the brush.

When the cap-like fastening has been removed, tooth paste may be dispensed through the opening, 9, onto the bristles, 4. For ease of handling, the neck of the brush and the reservoir may be provided with temporary mounting means, 22, to temporarily attach the brush to the reservoir, such that the bristles are disposed beneath the opening, 9, to receive tooth paste dispensed through the opening. As shown in FIG. 2, the temporary mounting means may be a tab, 22*a*, on the neck portion of the brush, with corresponding indentation or groove, 22*b,* in the reservoir. FIG. 3 illustrates the reassembled toothbrush, ready for use.

As shown in FIG. 4, the cap-like fastening means, 7, may be formed of a coupling, 16, the proximal portion, 17, of which is firmly but releasably attached to the foreshortened handle fastening means, 18.

Figure 5A:
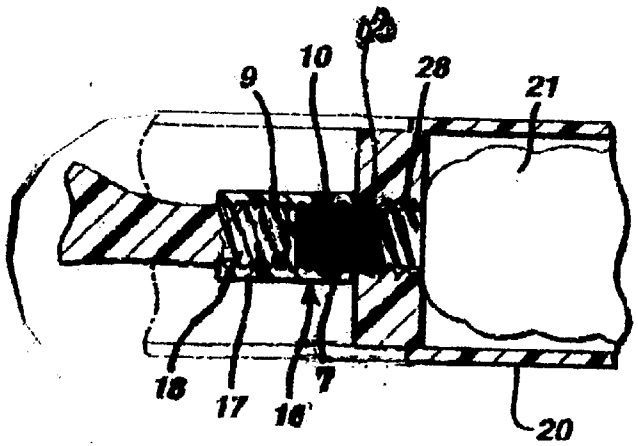
FIG. 5A is an expanded cross-sectional view of the coupling of FIG. 5, and its attachment to the toothbrush and rigid body.

As may best be seen in FIG. 5, in this embodiment of the invention, the reservoir, 8, comprises a pliable tooth paste sack, 21 within a rigid body, 20, and means, 24, for applying pressure to the sack to dispense tooth paste through the dispensing opening 9. In the particular embodiment shown in FIG. 5, the means, 24, comprises a tab, 25, attached to the distal end of the sack, the ends of the tab disposed within opposed tracks, 26, of the body, 20. A distal portion of the body is rotatably attached to the remainder of the body. As this distal portion, 27, of the body is turned, the tab twists the sack, and dispenses tooth paste through the opening, 9. Twisting of the sack decreases its volume and length, hence the tab will travel up the tracks as the tooth paste is dispensed. Once sufficient tooth paste has been dispensed, the cap-like fastening means, 7 may be re-attached to the reservoir fastening means, 10, and the body, 20, used as the handle for the toothbrush. As shown in FIG. 5A, the reservoir fastening means, 10, may comprise an extended sack fastening means, 23, passing through an aperture, 28, in the proximal end of the body. The reservoir fastening means may be attached to the body by internal threads in the aperture, 28, attaching the sack to the body.

As shown in FIG. 5, the tooth brush cap may be provided with attachment means, 12, may comprising e.g. a beveled edge, 12*a,* to which the inner surface, 12*b,* of the distal end of the cap makes a frictional, releasable attachment. The cap may also have exterior mounting means, 13, such as the pen-like clip shown in FIGS. 1 and 5.

If desired, the tooth paste sack may be easily refilled. Referring to FIGS. 4 and 5, when the cap-like means is constructed from a coupling, the foreshortened handle fastening means, 18, may be detached from the proximal fastening means of the coupling, 17, to create a refilling opening, 9'. The proximal fastening means, 17, accommodates the dispensing opening of another tooth paste reservoir, such as a commercial tooth paste tube. If desired, the coupling may be removed, and the sack refilled through the dispensing opening, 9. It should be noted that one may keep the coupling attached to the body while dispensing tooth paste, in which case the tooth paste will be dispensed through the coupling, 16, and the refilling opening, 9'.

Figure 7:
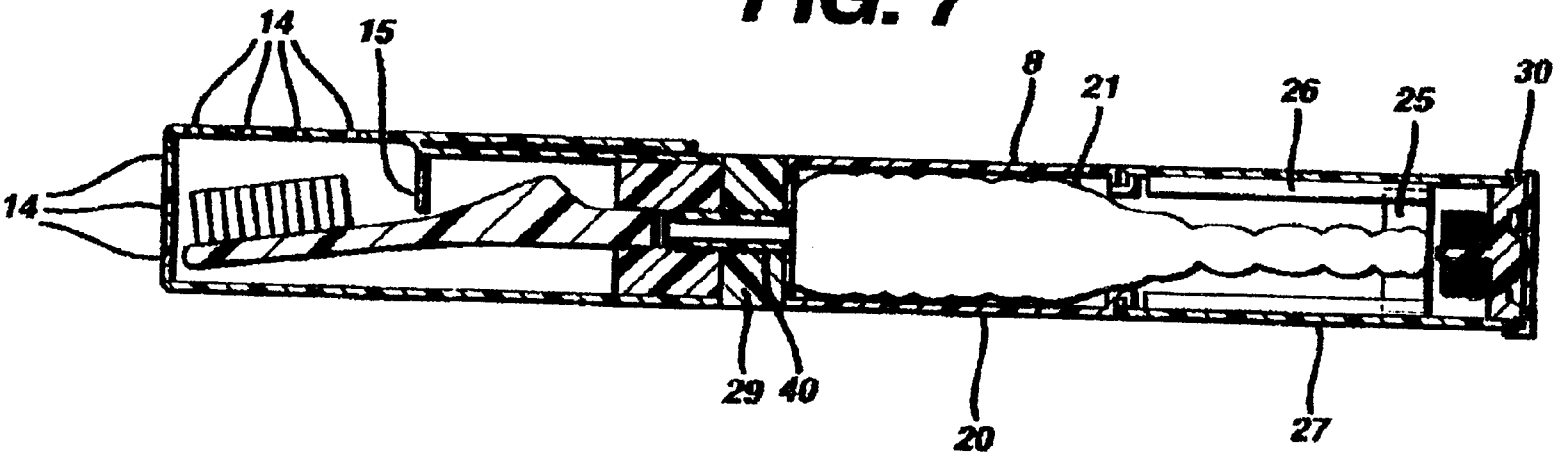
FIG. 7 is a cross-sectional view of another embodiment of the invention, illustrating some preferred, but optional, features.
Figure 7A:
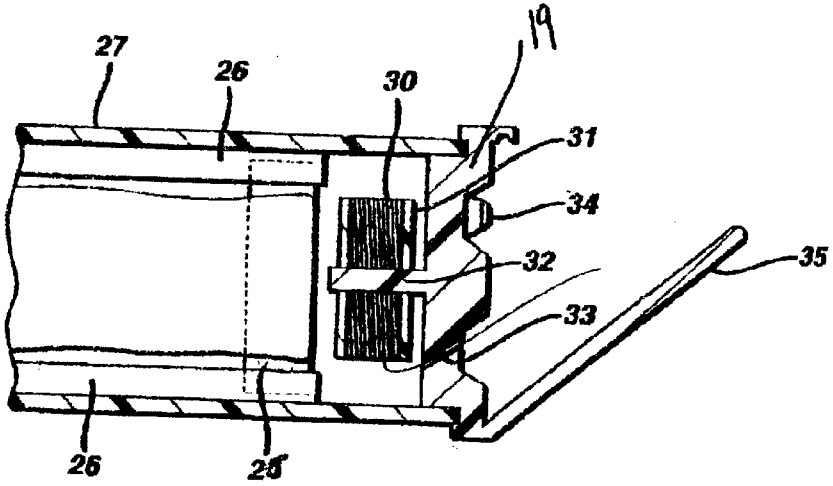
FIG. 7A is an enlarged cross-sectional view of the distal end of the embodiment of FIG. 7, illustrating the dental floss dispenser.
Figure 7B:
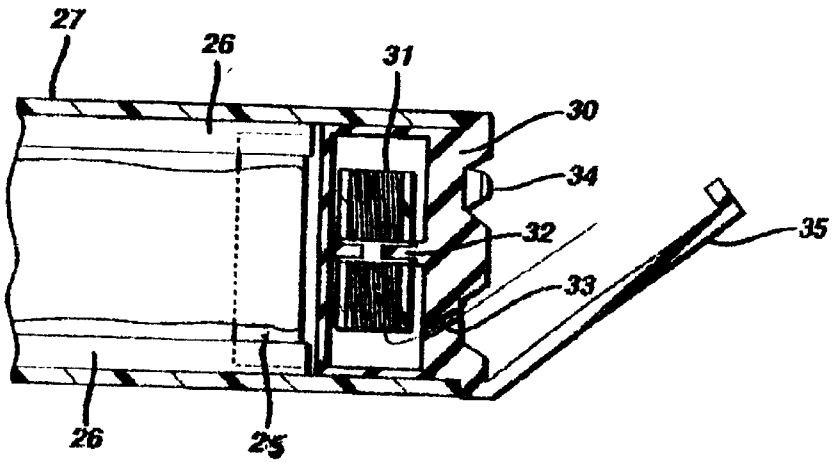
FIG. 7B is an enlarged cross-sectional view of the distal end of the body, similar to FIG. 7A, but illustrating another floss dispenser.

The compact dental hygiene kit of the present invention may be provided with various optional, but preferred features, some of which are shown in FIGS. 7, 7A and 7B. As shown in FIG. 7, the cap may be provided with a dewatering flange, 15 at the distal end of the cap. The flange 15, has sufficient dimension to flick the bristles as the cap is placed over the brush flicking the moisture off the bristles. The cap may also be provided with drying apertures, 14. Also shown in FIG. 7, the sack may be additionally, or alternatively attached to the body by ring, 29, with internal grasping means, such as a thread shown in FIG. 7, for firmly engaging the reservoir fastening means, 10. It should also be clear that the reservoir fastening means could be firmly fixed to, or integral with, the body, and the sack attached to the body so as to dispense tooth paste through the opening 9.

Another preferred feature is a floss dispenser, shown generally at 30 in FIGS. 7, 7A, and 7B. The dispenser may comprise a spool 31, on axle, 32, attached to the end cap, 19, which is releasably attached to the distal end of the body. Preferably, the floss dispensers, 30, are provided with a floss opening, 33, and a cutter, 34, for dispensing cut sections of dental floss. A lid, 35, may be provided to cover the floss opening and cutter when not in use. The dispenser may be formed of, e.g. a resilient rubber-like material, so that the floss dispenser may be attached within the distal end of the body, and maintained therein by the resilience of the dispenser, as shown in FIG. 7B.

Figure 8:
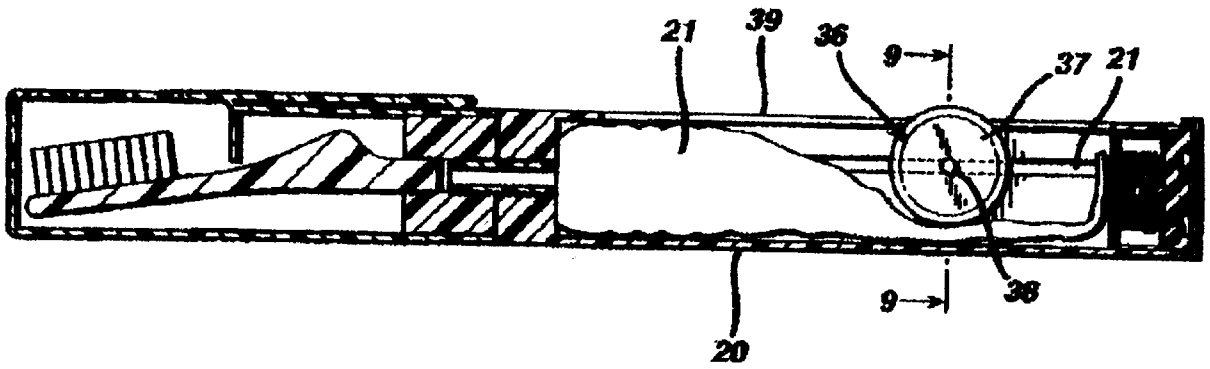
FIG. 8 is a cross-sectional view of another embodiment of the invention, illustrating alternative dispensing means for dispensing tooth paste from the tooth paste reservoir.
Figure 9:
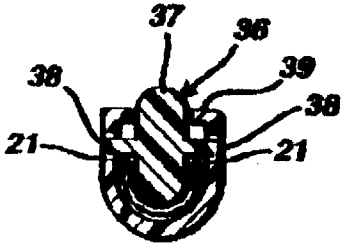
FIG. 9 is a cross-sectional view of the embodiment of FIG. 8, taken along line 9—9.
Figure 8A:
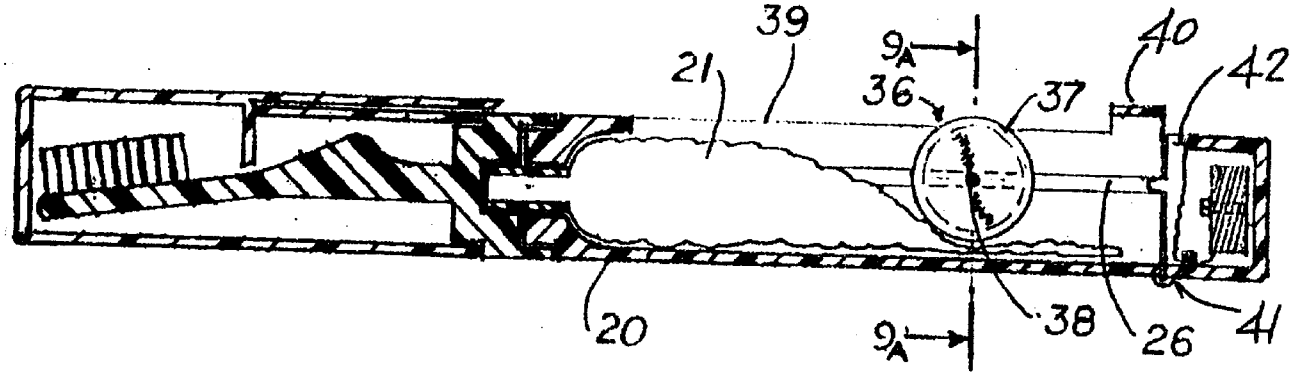
FIG. 8A is a cross-sectional view of another embodiment of the invention, illustrating a cap-like fastening means integral with the brush, and an alternative dispensing means for dispensing tooth paste from the tooth paste reservoir.
Figure 9A:
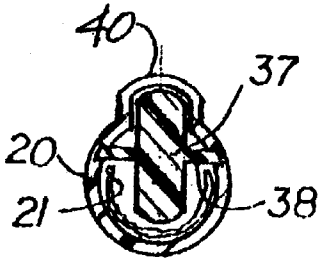
FIG. 9A is a cross-sectional view of the embodiment of FIG. 8A, taken along line 9A—9A.

FIGS. 8 and 8A illustrate an alternate tooth paste dispensing means, 36, comprising a wheel, 37, mounted on, and rotatable about, an axle 38, the ends of which are disposed in tracks, 26. In this embodiment the body, 20, contains a longitudinal opening, 39, extending parallel to the tracks, to expose the wheel, 37 to rotation, to dispense the tooth paste from the sack. As shown in FIGS. 8A and 9A the distal end of the body may be raised, as at 40, to permit insertion of the wheel before the floss dispenser on hinge 41 is attached, at 42, to the distal end of the body. As shown in FIGS. 9 and 9A, the longitudinal opening gives the body, 20, an open u-shaped cross-section. If desired, the toothbrush cap may also have a closed u-shaped cross-section. If the longitudinal opening is wide enough, a finger may be used to dispense the tooth paste, eliminating the need for tracks, wheel and axle. If it is desired not to refill the sack, but to substitute a commercially available tooth paste tube for the sack, the longitudinal openings in the body need to be large enough to easily apply pressure to the commercial tube to dispense the tooth paste.

Figure 10:
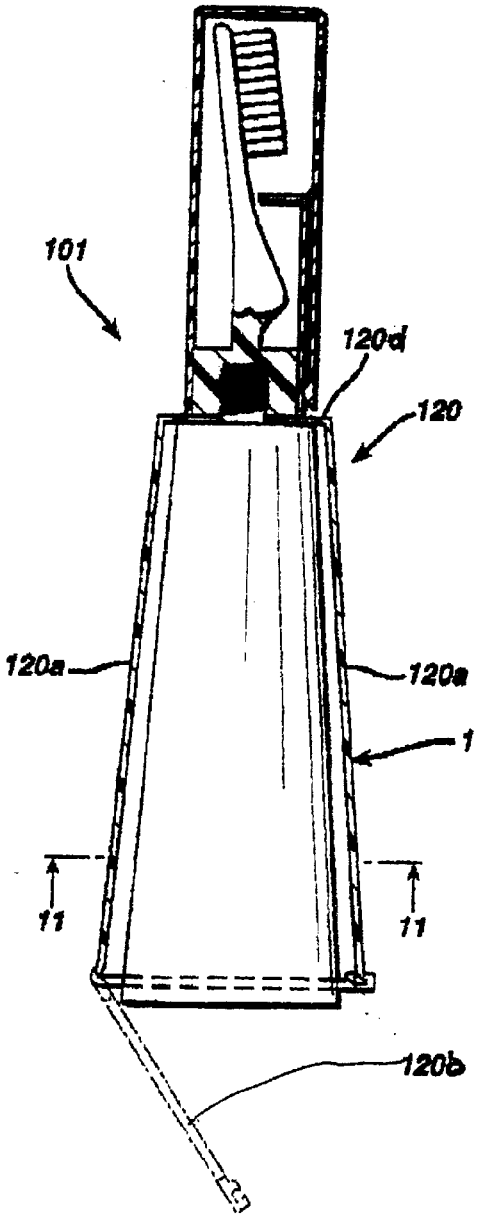
FIG. 10 is a partial cross-sectional view of another embodiment of the present invention, having an enclosure for a commercial tooth paste tube.
Figure 11:
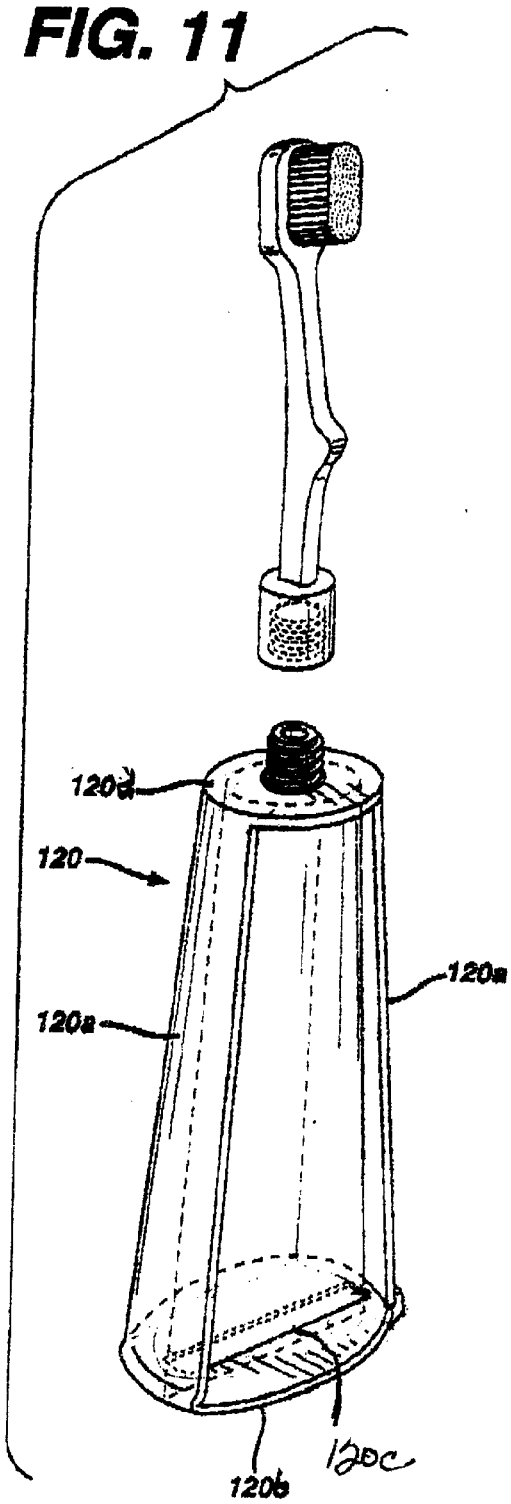
FIG. 11 is an exploded perspective view of the embodiment of FIG. 10, with the cap removed.
Figure 12:
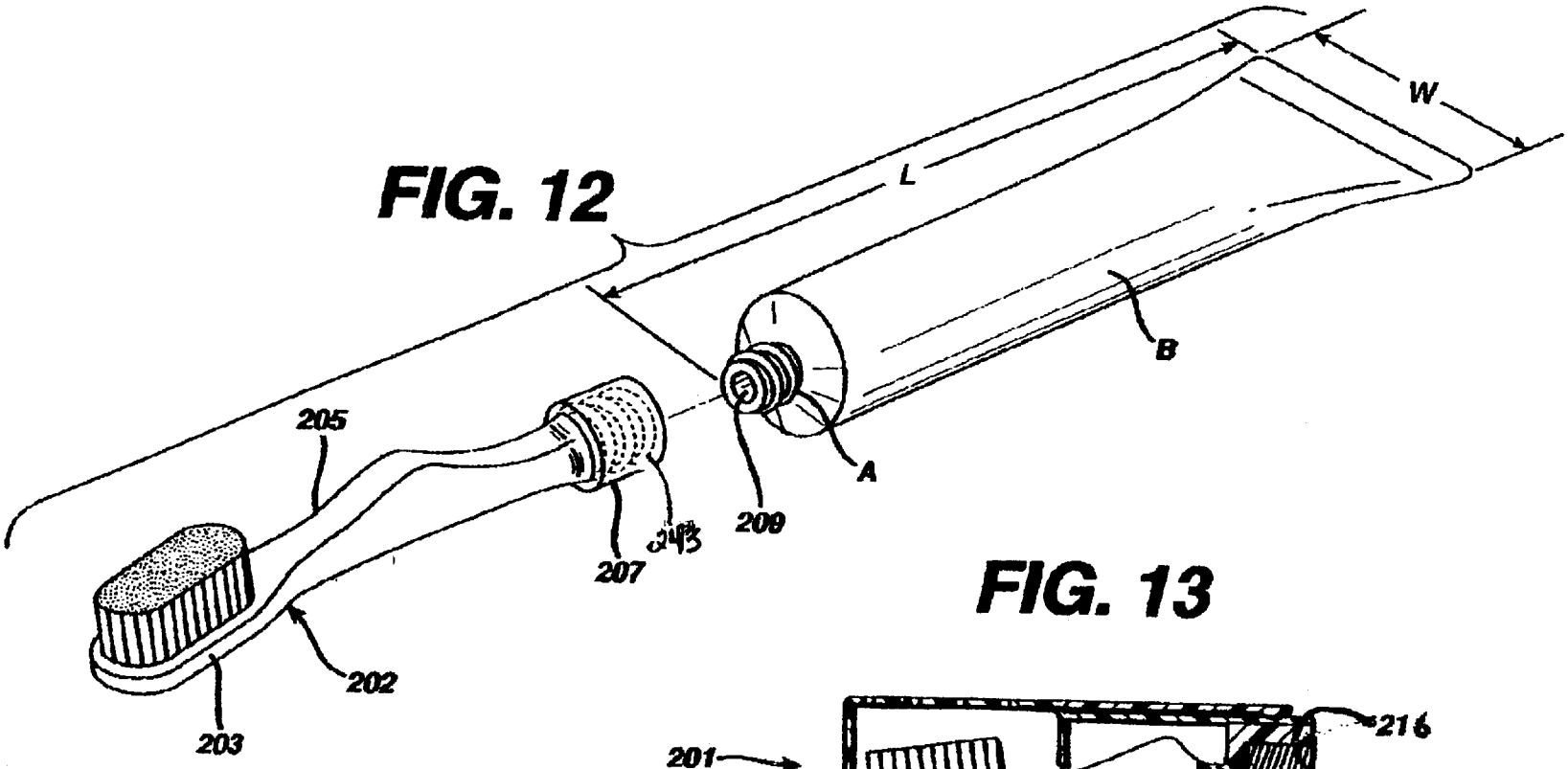
FIG. 12 is an exploded perspective view of the simplest embodiment of the present invention, and a commercially available tooth paste tube.
Figure 13:
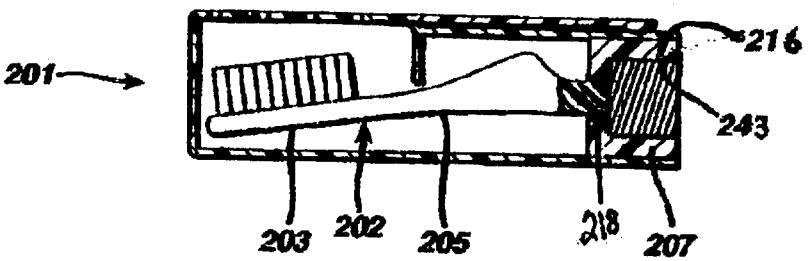
FIG. 13 is cross-sectional view of the embodiment of FIG. 12 with a cap added.

When it is desired to use commercial tooth paste tubes as a tooth paste reservoir, a simple, inexpensive framework, as shown in FIGS. 10 and 11, at 120, may be used instead of a full rigid body structure. The frame comprises at least one longitudinally extending rib, 120*a*, (in this embodiment a crescent, in cross-section) connected at its distal end to a distal bar 120*b*, approximately perpendicular to the rib(s), with slot, 120*c,* for receiving the distal end of a commercial tooth paste tube. The other end of said rib(s) is are connected to a proximal frame portion, 120*d,* parallel to the distal bar, and surrounding the tube dispensing opening; the proximal frame portion lying snugly against the proximal surface of the tube when the distal end of the tube is placed within the slot, 120*c,* of the distal bar, 120*b.* When two or more longitudinal bars are used, the distal bar may be hinged, and snapped to a longitudinal bar, as shown.

As seen in 12 and 13, the commercially available tooth paste tube, especially in the smaller sizes, may be rigid enough to function as a handle for a handle-less toothbrush with a cap-like fastening means. The handle-less, toothbrush, 202, has a brushing head, 203, with neck portion 205, and a cap-like fastening means 207, which may be formed integrally with the neck, or, as shown in FIG. 5, from a coupling, 216, the proximal fastening means, 217, of which makes a firm attachment to foreshortened handle fastening means, 218 of the brush.

The toothbrush, cap, body, and framework may be made of light, resilient, and colorfull plastic material. In addition, they may carry the name or insignia of a hotel, dentist, person or organization. While particular embodiments of the present invention have been described therein, it will be understood that modifications can be made therein without departing from the spirit of scope of the invention. In the application, it is intended that the parts numbered in the 100's and 200's correspond to similar parts, and their descriptions given earlier with respect to FIGS. 1–6 and numbered in single digits.

Figure 14:
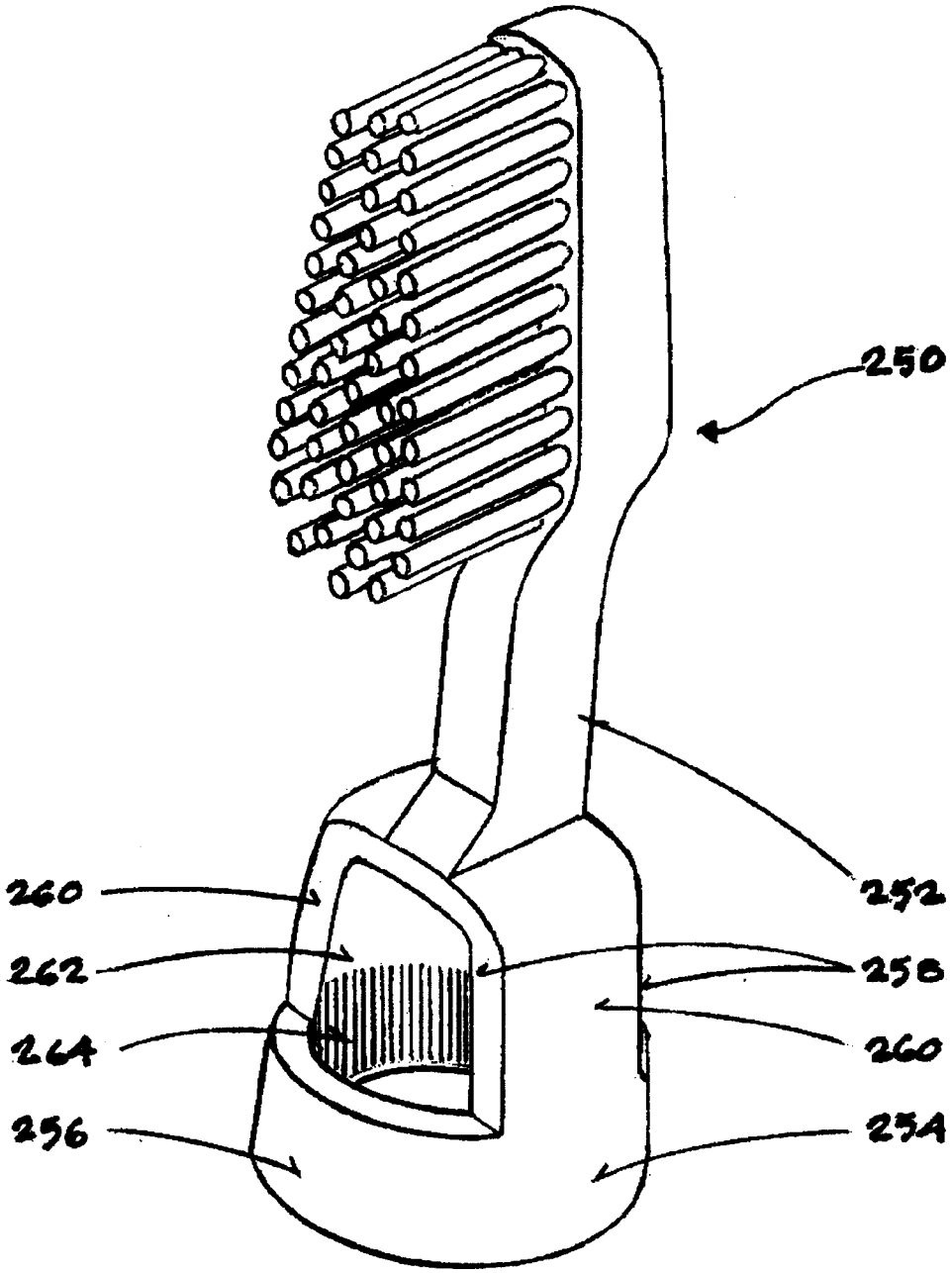
FIG. 14 is a perspective view of another handle-less toothbrush according to the present invention.
Figure 15E:
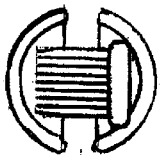
FIG. 15*e* is a top view of the toothbrush without locking ring of FIG. 15*d*.
Figure 15A:
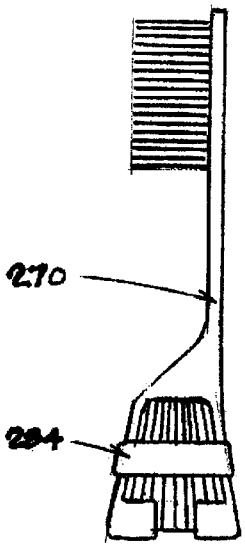
FIG. 15*a* is a side elevation of another handle-less toothbrush, with locking ring.
Figure 15B:
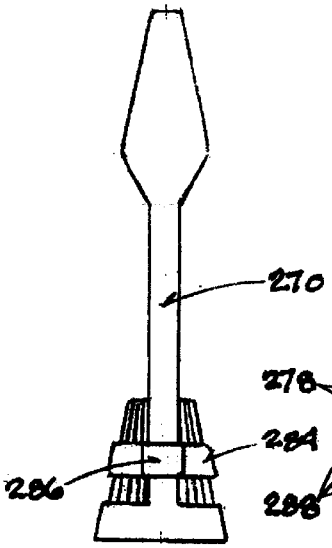
FIG. 15*b* is a back elevation of the toothbrush of 15*a*.
Figure 15D:
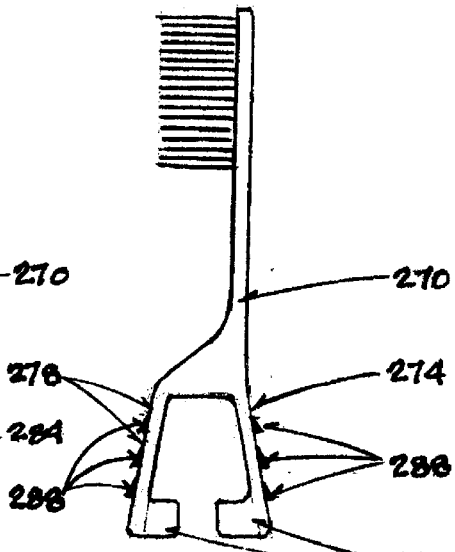
FIG. 15*d* is a side view of the toothbrush of FIGS. 15*a* and *b,* illustrating the toothbrush with locking ring removed.
Figure 15C:
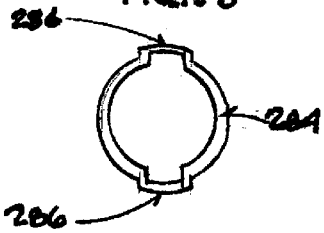
FIG. 15*c* is a top view of FIG. 15*b*, illustrating just the locking ring.

FIG. 14 shows another handle-less toothbrush, 250, according to the present invention. In this embodiment of the invention, the cap of the toothpaste tube is not replaced by the cap-like fastening means, but fastening is made to the cap. The neck of the toothbrush, 252, is attached to a cap fastening means, such as that shown at 254. The cap fastening means comprises a bottom ring, or base, 256. The inside surface, 262, of the bottom ring is tapered to create a fastening means, which is flush to the perimeter of the cap, or has knurls, 264, which mate with the ribs on a conventional commercially available tooth paste tube. Preferably, the inside surface has a tapered, or frustroconical shape, so that the fastening means may make a fastening to caps with a range of diameters. To accommodate the range of commercially available caps, the fastening means, 254, also has at least two cut-outs, 258, which form two bridges, 260. Provision of the cut-outs, allows the fastening means to fit over caps of various sizes.

FIG. 15 shows another embodiment of the handle-less toothbrush of the present invention. This embodiment of the handle-less toothbrush, 270, has a locking means, locking ring, 284, to secure the fastening to the cap of a conventional commercially available tooth paste tube. The handle-less toothbrush has a cap fastening means, 274, comprising a slotted bottom ring, 276, and bridge members, 278, which fit about the cap, and secure the neck of the toothbrush, and locking ring, 284, which may be lowered along the sides of the bridging members until the bottom ring and bridge members fit tightly to the cap. The locking ring may have a key, such as the outbridge, 286, to secure the locking ring in a particular configuration; in this case, an outbridge which will mate with the neck of the brush and prevent rotation of the locking means. Bridge members, 278, may have teeth, 288, for locking that latitudinal position of the ring.

Figure 16:
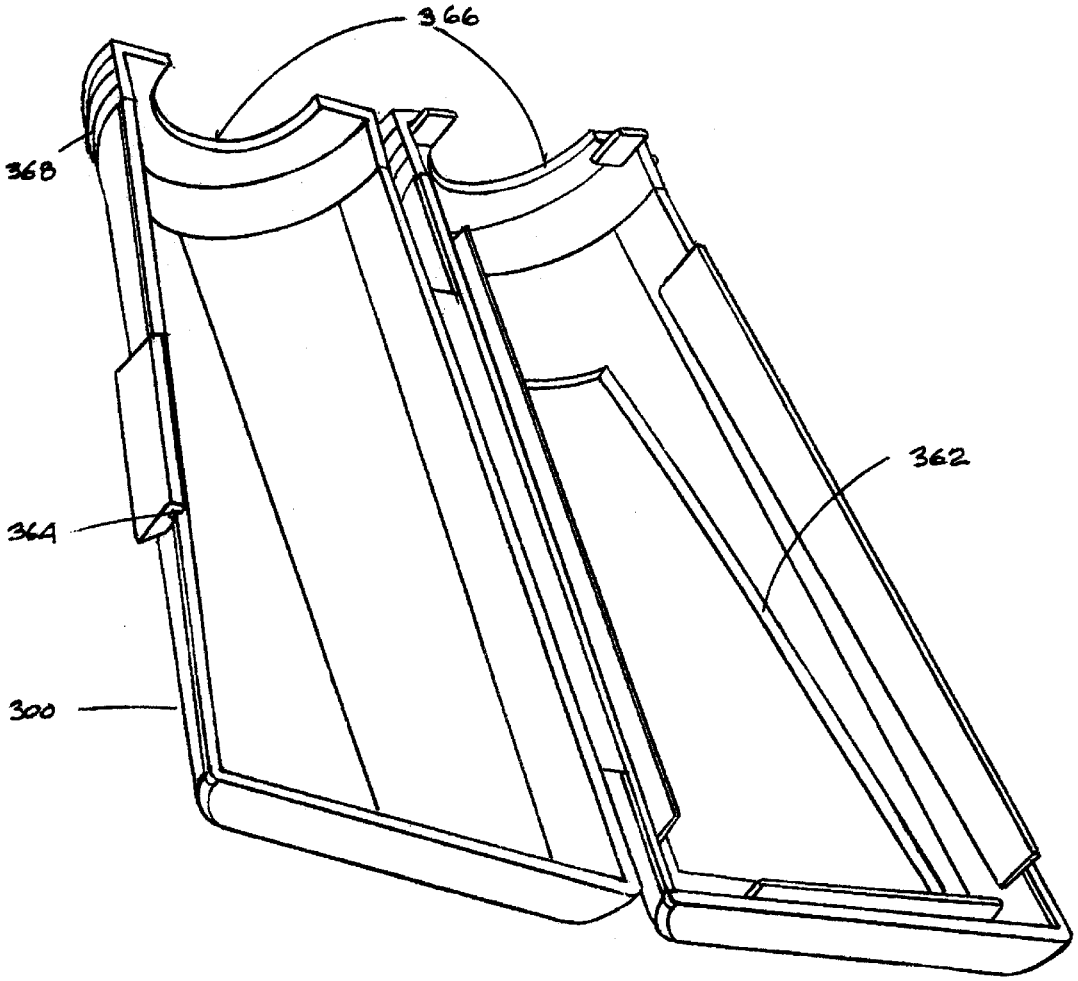
FIG. 16 is a perspective view of a reusable frame type of gg enclosure of the present invention.

FIG. 16 shows a reusable firm, 300, which may be used to create a firm enclosure for the tooth paste tube, so that it may become part of the handle of the toothbrush. Means are provided for dispensing tooth paste from the tube within the frame. The particular frame shown has at least one finger cut-out, 362, for applying pressure to the tube to dispense the tooth paste. The frame has opening(s), 366, for exposing the dispensing opening of the tube. The frame may also comprise a locking means, such as the snap-lock illustrated at 364. Complementary fastening means, 368, may be provided around the opening(s), 366, to make a fastening to a complementary closure means on the inside surface of the bottom ring of a handle-less toothbrush, to fasten the cap to the frame.

What is claimed:

1. A compact dental hygiene kit, comprising a toothbrush, comprising a brushing head, with a plurality of bristles, at the proximal end of the toothbrush, a neck portion, attached to the distal end of the brushing head, and a foreshortened handle, comprising a cap-like fastening means, attached to the distal end of the neck portion, and a tooth paste reservoir comprising a rigid body with a dispensing opening, and a refillable, pliable tooth paste sack having a dispensing opening in communication with the dispensing opening of the rigid body to create a reservoir dispensing opening, said sack being always maintained within and secured to the rigid body said tooth paste reservoir having fastening means, about the reservoir dispensing opening, complementary to the cap-like fastening means of the foreshortened handle, for attaching the brush to the reservoir.

2. A compact dental hygiene kit as in claim 1, wherein the cap-like fastening means comprises a coupling, the proximal portion thereof being releasably attached to the foreshortened handle fastening means at the distal end of the neck portion, the distal end of said coupling having fastening means complementary to the fastening means about the dispensing opening.

3. The dental hygiene kit of claim 2, having refilling means, comprising said coupling, the proximal portion of said coupling making a temporary attachment to threaded dispensing opening of a conventional tooth paste tube, whereby the tooth paste may be forced out of another tube, through the refilling means, and into the reservoir.

4. The dental hygiene kit of claim 2, further comprising a cap covering the bristles of the toothbrush.

5. The dental hygiene kit of claim 4, wherein the cap further comprises exterior mounting means, and a dewatering flange, adapted to bend and release the bristles of the toothbrush as the cap is disposed over the toothbrush.

6. The dental hygiene kit of claim 5, further comprising means, for temporarily mounting the toothbrush to the reservoir such that the bristles are adjacent the dispensing opening.

7. A compact dental hygiene kit, comprising a toothbrush, comprising a brushing head, with a plurality of bristles, at the proximal end of the toothbrush, a neck portion, attached to the distal end of the brushing head, and a foreshortened handle, comprising a cap-like fastening means, attached to the distal end of the neck portion, and a tooth paste reservoir comprising a rigid body with a dispensing opening, and a refillable, pliable tooth paste sack having a dispensing opening in communication with the dispensing opening of the rigid body to create a reservoir dispensing opening, said sack being always maintained within and secured to the rigid body said tooth paste reservoir having fastening means, about the reservoir dispensing opening, complementary to the cap-like fastening means of the foreshortened handle, for attaching the brush to the reservoir, and wherein said fastening means 10 comprises an extended sack fastening means, 23, which passes through the proximal end of the rigid body.

8. A dental hygiene kit as in claim 7, having a dispensing means for applying pressure to the sack to dispense tooth paste therefrom, said means comprising a distal portion of the rigid body, rotatably attached to the body, and having opposed tracks on its interior surface, and a tab, firmly attached to the distal end of the sack, the ends of said tab extending perpendicularly of the distal end of the sack into the respective tracks, whereby when said distal portion is rotated, the tracks engage the ends of the tab, rotating the tab, which rotates the distal end of the sack.

9. A dental hygiene kit as in claim 7, wherein the fastening means, 10, comprises an extended sack fastening means which passes through an aperture in the proximal end of the body, and is secured thereto by a ring with internal fastening means, said ring being attached to the distal end of the fastening means, 10, and of a height to leave exposed the proximal end of the fastening means, 10, to receive the cap-like fastening means.

10. The dental hygiene kit of claim 5, having a dental floss dispenser, attached to the proximal end of the reservoir.

11. The dental hygiene kit of claim 10, wherein the floss dispenser comprises a spool with an axle, said axle being rotatably fastened to the dispenser, and an opening in the dispenser for dispensing lengths of the floss.

12. A dental hygiene kit as in claim 7, wherein the dispensing means for applying pressure to the sack to dispense tooth paste therefrom comprises opposed tracks on the surface of the distal portion of the rigid body, a longitudinal opening in the body, between the tracks, and a wheel, rotatably mounted on an axle, the ends of the axle extending into the tracks, said wheel passing on one side of the sack, and being of diameter equal to or greater than the diameter of the distal portion of the body, such that the wheel extends through the longitudinal opening, and is freely rotatable to dispense tooth paste from the sack.

13. The dental hygiene kit of claim 12, wherein the dispenser further comprises a floss cutter secured to the dispenser near the floss dispensing opening, and a lid, which covers the cutter and the floss dispensing opening.

14. A compact dental hygiene kit, comprising a toothbrush, comprising a brushing head, with a plurality of bristles, at the proximal end of the toothbrush, a neck portion, attached to the distal end of the brushing head, and a foreshortened handle, comprising a cap-like fastening means, attached to the distal end of the neck portion, and a tooth paste reservoir comprising a re-usable frame for a toothpaste tube, said frame comprising two sides connected by a hinge for opening and closing the frame, and an opening in the closed frame sufficient for exposing the dispensing opening of a toothpaste tube contained in the closed frame, creating a a reservoir dispensing opening, and fastening means, about the reservoir dispensing opening, complementary to the cap-like fastening means of the foreshortened handle, for attaching the brush to the reservoir, whereby, said tooth paste reservoir can be used as a handle for the toothbrush.

15. A compact dental hygiene kit as in claim 14, wherein the frame further comprises temporary locking means for securing the frame in a closed position.

16. A compact dental hygiene kit as in claim 14, wherein at least one side of said frame having a cut-out for applying pressure to the tube to dispense tooth paste from the reservoir.

17. A compact dental hygiene kit as in claim 14, wherein the cap-like fastening means of said foreshortened tooth brush comprises a coupling, releasably attached to the foreshortened handle, and having fastening means complementary to the fastening means about the reservoir dispensing opening.

18. The dental hygiene kit of claim 14, further comprising a cap covering the bristles of the toothbrush.

19. A foreshortened toothbrush for use in conjunction with a commercially available toothpaste reservoir, having a tooth paste dispensing opening and fastening means about the opening, said tooth brush comprising a brushing head, with a plurality of bristles, connected to a neck portion, and a cap-like fastening means attached to the neck portion, said cap-like fastening means being adjustable to a range of diameters whereby said foreshortened tooth brush may engage the fastening means about the tooth paste dispensing opening of the tube, capping the tube, and serving as the handle for the toothbrush.

20. A toothbrush as in claim 19, wherein the cap-like fastening means comprising a frustum-conical structure with knurls on its inner surface.

21. A toothbrush as in claim 20, wherein the frustum-conical structure comprises a slotted bottom ring, and an adjustable locking ring, and bridge members extending from the neck portion of the brush, into the locking ring.

22. A firming enclosure for use with a toothpaste tube having a toothpaste dispensing opening with fastening means disposed about the dispensing opening, and an annlar shoulder extending radially from the edge of the fastening means, to be used with a toothbrush as in claim 19, said firming enclosure comprising a) a proximal portion having a radius slightly smaller than the shoulder radius of the tube, and an aperture therein, throuogh which may be disposed the toothpaste tube dispensing means, and b) a shoulder cap portion attached to the proximal portion at an angle of about 90 degrees or more, and c) at least one longitudinal rib attached to the shoulder cap, said cap-like fastening means temporarily but firmly securing the proximal portion of the enclosure to the annular shoulder of the tube, with said cap-like fastening means and toothpaste dispensing opening extending from the firming enclosure.

23. A firming enclosure, as in claim 22, wherein the enclosure has distal end portion attached to said at least one rib.

24. A firming enclosure as in claim 23, wherein the distal end portion has an open slot for receiving the toothpaste tube.

25. A firming enclosure, as in claim 22, having a flattened distal end with a groove for engaging the distal end of the tube.

* * * * *